United States Patent [19]

Winkler et al.

[11] 4,451,215

[45] May 29, 1984

[54] ROTARY PISTON APPARATUS

[75] Inventors: Ottmar Winkler, Schweinfurt; Egon Pfaller, Dittelbrunn, both of Fed. Rep. of Germany

[73] Assignee: SKF Kugellagerfabriken GmbH, Schweinfurt, Fed. Rep. of Germany

[21] Appl. No.: 254,058

[22] Filed: Apr. 14, 1981

[30] Foreign Application Priority Data

Apr. 16, 1980 [DE] Fed. Rep. of Germany ..... 3014520

[51] Int. Cl.[3] ..... F04C 2/00

[52] U.S. Cl. ..... 418/23; 418/260

[58] Field of Search ..... 418/173, 257, 258, 259, 418/260, 266, 263, 23

[56] References Cited

U.S. PATENT DOCUMENTS

| | | | |
|---|---|---|---|
| 1,294,760 | 2/1919 | Bowser | 418/260 |
| 1,676,783 | 7/1928 | King | 418/173 |
| 3,373,723 | 3/1968 | Blosser | 418/259 |
| 3,981,641 | 9/1976 | D'Amato | 418/81 |
| 4,106,472 | 8/1978 | Rusk | 418/266 |

FOREIGN PATENT DOCUMENTS

| | | | |
|---|---|---|---|
| 2022678 | 10/1972 | France . | |
| 230193 | 3/1925 | United Kingdom | 418/23 |
| 528036 | 10/1940 | United Kingdom | 418/173 |
| 706292 | 3/1954 | United Kingdom | 418/257 |

*Primary Examiner*—Leonard E. Smith
*Assistant Examiner*—Jane E. Obee
*Attorney, Agent, or Firm*—Eugene E. Renz, Jr.

[57] ABSTRACT

Rotary piston assembly comprising a housing having a bore, a piston rotatably mounted in the housing, a plurality of slide vanes distributed about the circumference of said piston, each slide vane supported for pivotal movement about an axis parallel to the axis of rotation of said piston, said slide vanes operable to pivot and engage the bore of the housing during rotation of the piston due the effect of centrifugal force, each of said slide vanes being of arcuate, vane shaped configuration having an enlarged end section of generally circular cross section, means defining a plurality of axially directed, circumferentially spaced arcuate recesses on the outer peripheral surface of said rotary piston to receive the end sections of said pivoted slide vanes.

9 Claims, 13 Drawing Figures

FIG.4
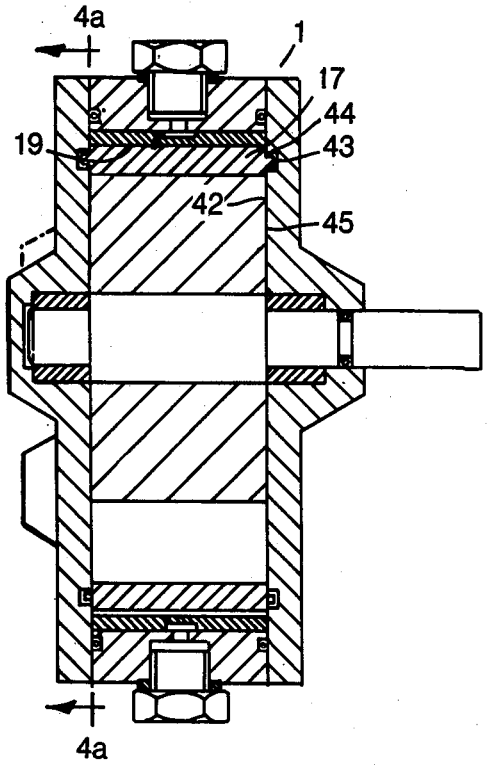
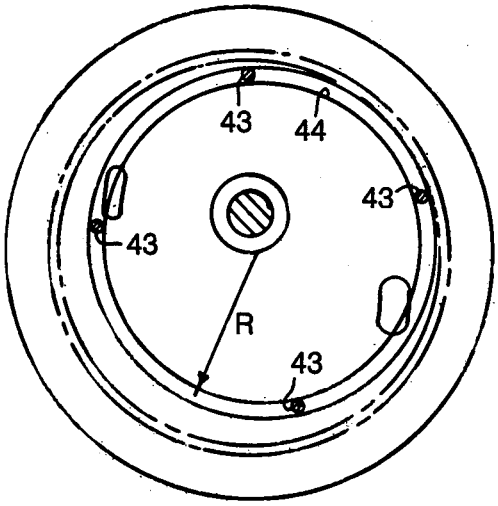
FIG.4a
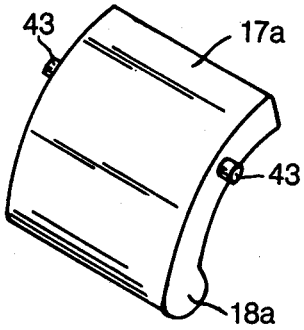
FIG.4b

FIG.5
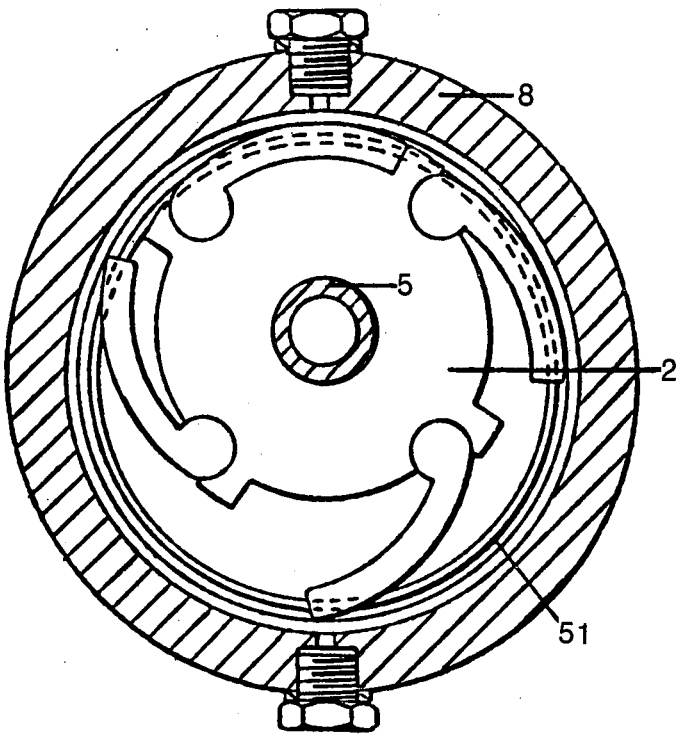
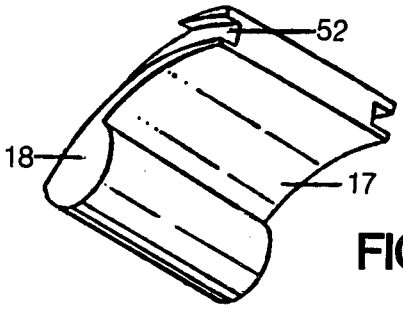
FIG.5b
FIG.5a
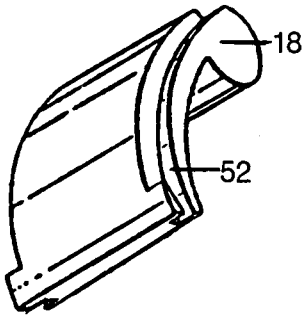

ROTARY PISTON APPARATUS

BACKGROUND AND SUMMARY OF THE INVENTION

The present invention relates to improvements in rotary piston assemblies. More specifically, the invention relates to a rotary piston for segmented pumps supported in a housing on which a plurality of pivoted slide vanes which are distributed evenly over the circumference and which are pivotally hinged about axes parallel to the axis of rotation of the rotary piston whereby the pivoted slide vanes engage the bore of the housing during rotation of the rotary piston due to the centrifugal force effect.

Rotary piston assemblies having a rotary piston supported eccentrically in the housing are not new per se. In one such known prior assembly shown in U.S. Pat. No. 1,458,361, four pivoted slide vanes are distributed evenly over the circumference which can be pivoted by means of a lever about an axis running parallel to the axis rotation of the rotary piston. The pivoted slide vanes are connected to a lever and move in this instance, essentially radially to the rotary piston to engage the cylindrical bore of the housing at an interface. The levers are hinged to the rotary piston by means of separate bolts which engage through bores of the lever.

In another similar construction shown in German Pat. No. 1,286,851, the pivoted slide vanes are arranged in chambers of the rotary piston and are pivotally hinged by means of support bolts. In this instance, the pivoted slide vanes are laterally split in order to provide a suitable seal. An adjusting device is provided by means of which the sealing part can be adjusted in the direction of the common longitudinal axis in relation of the hinged support of the pivoted slide vane and rotated about this axis.

In these known prior constructions, the cavities or chambers for housing the pivoted slide vanes form relatively deep recesses in the rotary piston so that for reasons of space and stability, the radial dimensions of the rotary piston are very large and it is difficult to accommodate these designs to rotary piston assemblies with relatively small radial dimensions. Furthermore, the pivoted slide vanes which essentially move radially are guided along a curved sealing surface of the chambers. In these known constructions therefore, there are four sealing surfaces which are difficult to design to provide optimum and inexpensive sealing. Further, since the pivoted slide vanes engage and slide along the bore surface of the housing under radial pressure, friction and wear is extensive. The wear and friction which thus occurs in operation increase the power losses so that efficiency of these known constructions is rather poor. The relatively complicated shape of the elements or components as well as the additional fastening means required for the pivoted slide vanes means that production and assembly are rather complicated and rather costly. Precision machining of the individual components to obtain adequate sealing also add to the cost of production.

With the above in mind, it is an object of the present invention to provide a rotary piston assembly of simplified construction which can be produced and assembled economically and is characterized by a novel compact structural arrangement wherein there are low or negligible friction and wear losses.

To this end, in accordance with the present invention, the pivoted slide vanes are of a vane shape, arcuate configuration for example, circular ring segments and have an integral end section of generally enlarged circular cross section and the rotary piston is provided with a number of generally circular recesses on the outer surfaces thereof distributed about the circumference which run in an axial direction to define pockets pivotally receiving the end sections of the slide vanes.

The pivoted slide vanes are thus of a rather simplified shape so that they can be made of preformed material and need only to be cut to the desired length. The circular end section of the pivoted slide vanes as well as the correspondingly or complementary shaped circular recesses in the rotary piston make it possible to fasten the slide vanes to the rotary piston with a simple fastening arrangement. Furthermore, the rotary piston can also be made simply from preformed materials from which the individual sections are cut to the desired width.

In accordance with another feature of the present invention the pivoted slide vanes are essentially arranged tangential to the outer peripheral surface of the rotary piston. Accordingly, there is a rather small radial extension so that the assembly is rather compact in terms of its small radial dimensions. Furthermore, by this construction, sealing of the pivoted slide means against a chamber in the rotary piston is not necessary so that the number of sealed surfaces is reduced. In accordance with another feature of the present invention, the rotary piston is provided with flat indentations about its circumference adapted to the cross sectional shape of the pivoted slide vanes and into which the slide vanes can be folded or nested. This construction further reduces the radial construction height of the assembly and makes it even more compact. Furthermore, in this manner the cross sectional height of the pivotal slide vanes themselves can be drastically reduced.

In accordance with another feature of the present invention, recesses or elevations are provided between the outer peripheral surface of the rotary piston and the surface of the pivoted slide vane confronting the pistons which interrupt the contact surfaces that serve to prevent a possible sticking of the pivoted slide vanes to the rotary piston when circulating in a viscous medium. Radially acting spring elements may also be provided between the outer peripheral surface of the piston and the confronting surface of the pivoted slide vanes which normally urge the pivoted slide vanes from the corresponding indentations in the rotary piston.

Projections or the like may also be provided on at least one face of the slide vanes which nest or engage in curved recesses on the inside surface of the housing facing the side faces of the slide vane to provide a positive guiding of the slide vanes. Specifically, the projections leading into the recesses guide the slide vanes, that is, they open or close so that the slide vanes come to rest against the housing bore. In this manner, sticking of the pivoted slide vanes to the contact surfaces of the rotary piston is inhibited or prevented. The same effect can be obtained by providing the housing on at least one of the inside surfaces facing the side faces of the pivoted slide vanes with a curve projection which engages in a recess in the side face of the pivoted slide vane.

In some applications, it is desirable to rotate the rotary piston assembly without circulating the medium to be conveyed (zero forwarding or circulation) and to this end, in accordance with the preferred embodiment of the invention, radially directed slidable pins are arranged in the rotary piston adjacent each pivoted slide vane which pins engage with one end in a recess at the circular end section of the pivoted slide vane and the other end rests against the outside surface of an axially displaceable conical member which slides in a central bore in a shaft of the rotary piston. By this arrangement, when the conical member is moved axially in one direction, it displaces the pins outwardly so that the slide vanes are pivoted about their pivot axis and are nested into the indentations in the rotary piston. As a result of this, the closed chambers in which the medium can be circulated are no longer formed.

In accordance with another feature, a cylindrical sleeve which rotates in relation to the housing is mounted in the bore of the housing in order to further reduce friction and wear between the pivoted slide vanes and the bore of the housing. This "floating" sleeve rotates with the rotating slide vanes so that only slight relative movement may occur between the vanes and the inside peripheral sleeve wall and consequently very litle wear takes place. To facilitate rotation of the sleeve in the housing bore, grooves or the like adapted to supply and distribute a lubricant may be provided on its outer peripheral or in the confronting bore wall of the housing. The lubricant film produced in this way separates the confronting sliding faces of the sleeve and housing bore respectively. Friction and power loss may be reduced further in accordance with a further feature of the invention by utilizing grooves, for example, of spiral configuration on the axial end faces of the rotary piston for the supply and distribution of lubricant at the interfaces of the rotary piston.

Still a further feature of the invention which facilitates manufacture and machining of the housing is to make the housing from at least two disc shaped side components which support the bearings of the shaft of the rotary piston and which are connected by bolts or the like at the center section with the bore for the rotary piston. It is possible to connect the housing sections permanently after assembly by plastic deformation, welding or the like, for disposable rotary piston assemblies.

BRIEF DESCRIPTION OF THE DRAWINGS

These and other objects of the present invention of the various features and details of the operation and construction thereof are hereinafter more fully set forth with reference to the accompanying drawings wherein:

FIG. 4 is a transverse sectional view through a modified rotary piston assembly incorporating a positive guide arrangement for the slide vanes.

FIG. 4*a* is a sectional elevational view taken on lines 4*a*—4*a* of FIG. 4.

FIG. 4*b* is a perspective view of one of the slide vanes.

FIG. 5 is a side elevational view partly in section of a modified rotary piston.

FIG. 5*a* and 5*b* are perspective views of the slide vanes showing the curved projection engaging in a recess in the side face of the slide vane.

DESCRIPTION OF THE PREFERRED EMBODIMENT

Figure 1:
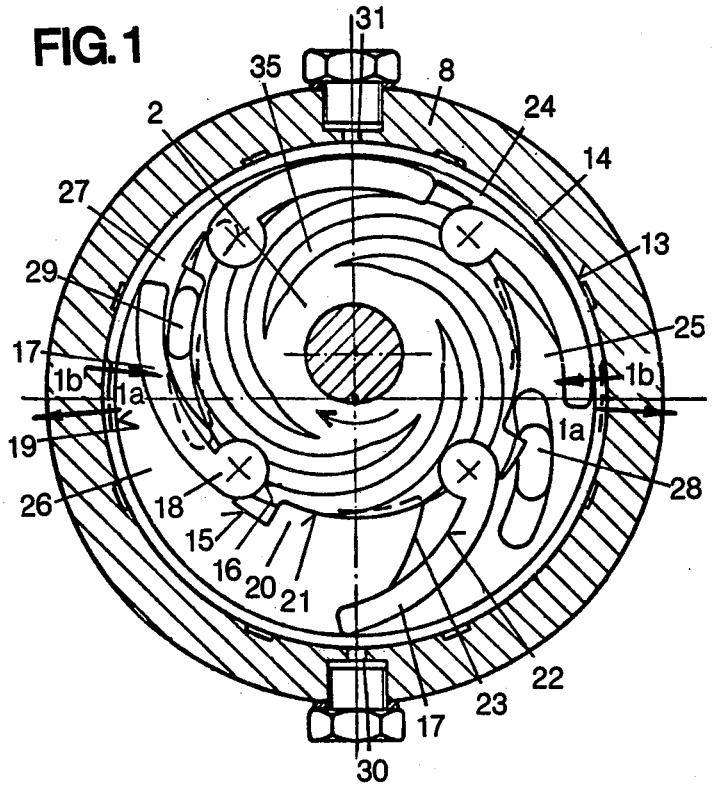
FIG. 1 is a side elevational view partly in section of a rotary piston assembly in accordance with the present invention with the side or end plate of the housing removed.
Figure 2:
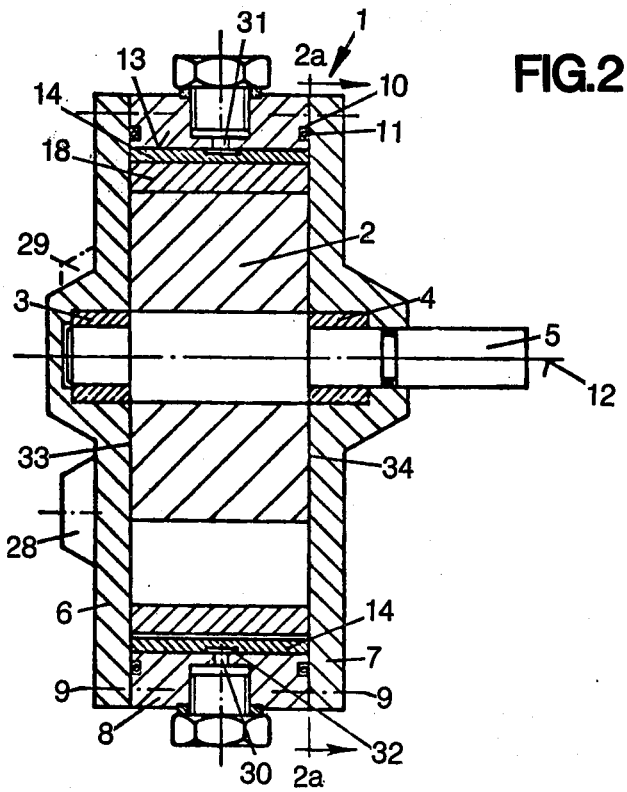
FIG. 2 is a cross sectional view taken on lines 2—2 of FIG. 2.

Referring now to the drawings and particularly to FIGS. 1 and 2 thereof, there is illustrated a rotary piston assembly in accordance with the present invention comprising a housing 1, a rotary piston 2 rotatably supported in the housing on a shaft 5 journalled in bearings 3 and 4. It is, of course, to be understood that the shaft may be journalled in rolling bearings instead of the plain bearings illustrated. The housing 1 is comprised of two disc-like side plates 6 and 7 having hub portions formed therein which support the bearings 3 and 4. A center section 8 encloses the rotary piston 2 and is disposed between the end plates and may be held in the assembled relation by a number of bolts 9 distributed over the circumference of the assembly. O-rings 11 mounted in annular grooves 10 of the center section seal the housing. The center section 8 of the housing 1 has a bore 13 eccentric to the axis of rotation 12 of the shaft 5 and of the rotary piston 2. A thin walled cylindrical sleeve 14 is mounted in this bore and is rotatable relative to the center section 8 and as described in more detail below is a "floating" sleeve.

Figure 1A:
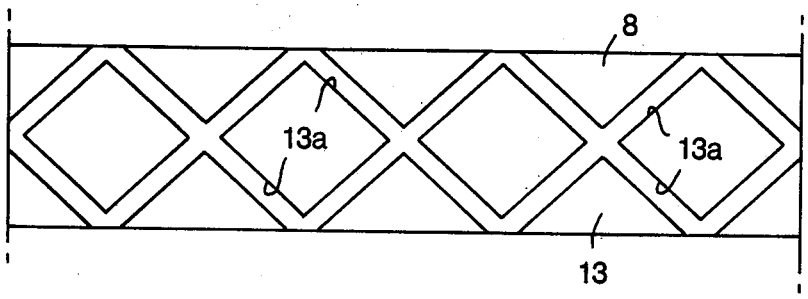
FIG. 1*a* is a fragmentary development taken on lines 1*a*—1*a* of Section 1 showing the lubrication distribution grooves in the bore of the housing.

As illustrated in FIG. 1*a*, the bore 13 of the housing may be provided with a lubricant distribution groove pattern 13*a* to facilitate rotation of the sleeve 14. The piston 2 is provided with a plurality of axially extending recesses 16 on its outer peripheral surface 15. In the present instance, there are four recesses 16 which have a circular cross section. Pivoted slide vans 17 of an axial width corresponding to the width of the center section 8 are pivotally mounted in the recesses 16. As illustrated, the side vanes 17 are vane-shaped or arcuate in cross section in the form of circular ring segments and extend essentially tangentially to the outer peripheral surface 15 of the rotary piston 2. Further, as illustrated, the slide vanes 17 have an enlarged end section 18 of generally circular cross section which engages in the recesses 16 of the rotary piston and pivotally supports in this manner the slide vanes 17 which during rotation of the piston assembly pivot outwardly due to centrifical force and engage the inner peripheral wall 19 of the sleeve 14.

Considering other details of the rotary piston 2, a series of flat indentations 20 adapted to the cross sectional shape of the slide vanes 17 are formed on the outer surface 15 which serve as pockets into which the slide vanes can be nested or folded in such a manner that a generally cylindrical surface can be formed. This provides a space saving arrangement, particularly in a radial direction and contributes to the compactness of the assembly. Biasing means, in the form of radially acting spring elements which in the illustrated embodiment comprise leaf springs 23 are provided between the bottom surface 21 of the indentations 20 and the surface 22 of the slide vanes 17 which they confront. The spring elements normally bias or urge the slide vanes 17 against the inner peripheral wall 19 of the sleeve 14 so that chambers 24, 25, 26 and 27 with volumes which change during rotation of the rotary piston are produced or formed. The leaf springs 23 prevent the slide vanes from adhering to the rotary piston and thus prevent forwarding or circulation of the medium to be conveyed. Inlet and discharge ports 28 and 29 are provided at diametrically opposed locations in the housing 1 for connection of supply and discharge lines for the medium to be conveyed.

Figure 1B:
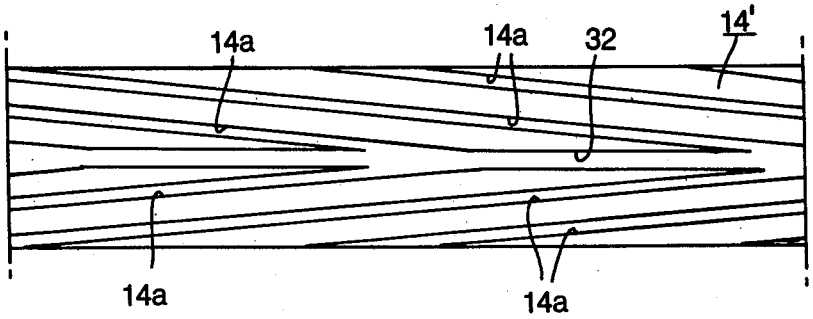
FIG. 1*b* is a view similar to FIG. 1*a*, but showing a fragmentary development of the outer peripheral surface of the sleeve mounted in the bore of the housing and taken on the line 1*b* of FIG. 1.

Considering now briefly operation of the assembly, when the rotary piston is rotated in the direction of the arrow illustrated in FIG. 1, the medium to be conveyed is drawn in through the inlet port 28 and is transported by the slide vanes 17 in the direction of the arrow to be discharged through the discharge port 29. As noted above, in this process, the volume of chambers 24, 25, 26 and 27 changes to produce a pressure increase in the medium. Lubricating means are provided so that the sleeve 14 rotates in relation to the housing and is readily carried along by the slide vanes which press against the inside wall of the sleeve. To this end, two diametrically opposed fittings 30 and 31 are provided in the center section 8 of the housing 1 which are connected to a suitable lubricant supply source sleeve 14 to conduct lubricant to the confronting surfaces between the sleeve 14 and the bore 13 of the housing which slide against each other. As illustrated in FIG. 1*b* the outer surface of the sleeve 14 has a groove arrangement to distribute lubricant comprising a central circumferential groove 32 and a series of spiral grooves 14*a*.

In this manner, the friction otherwise produced between the pivoting slide vane 17 and the wall of the housing bore which produces power losses is eliminated or at least substantially reduced. In addition to reducing friction, the wear of the slide vanes and the bore inner wall is also reduced so that the useful service life of the rotary piston assembly is extended substantially.

Figure 2A:
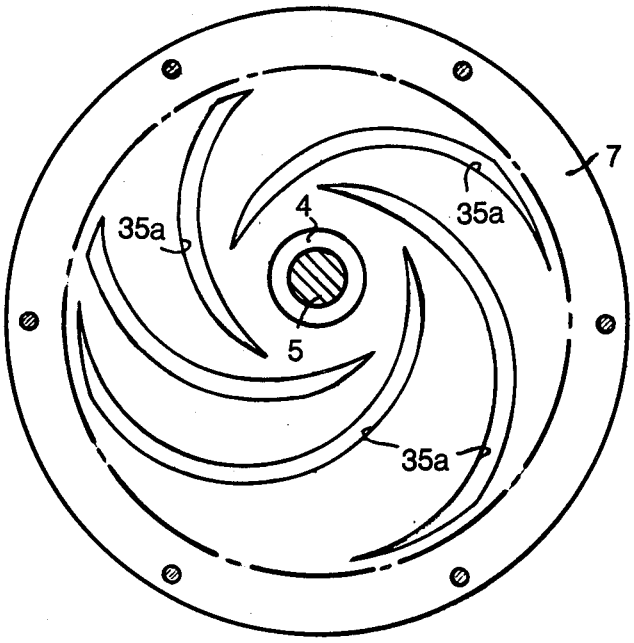
FIG. 2*a* is a fragmentary elevational view showing the lubrication distribution grooves on the inside facing of the side wall of the housing taken on line 2*a* of Section 2.

Spiral grooves 35 are also formed for example, by machining on the interfaces 33 and 34 of the rotary piston 2 to distribute lubricant between the confronting sliding surfaces. The interior face of the housing side walls may also be provided with a similar groove arrangement 35*a* as illustrated in FIG. 2*a*. This also reduces friction and conversely increases the efficiency and contributes to wear reduction. It is noted that if the medium to be conveyed has good lubricating properties in itself, the medium can be utilized for lubrication and thereby obviate the external lubricating system.

Figure 3A:
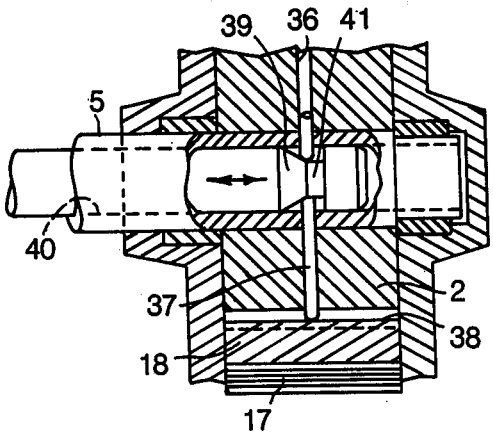
FIG. 3*a* is a fragmentary transverse sectional view taken on lines 3*a*—3*a* of Section 3.
Figure 3:
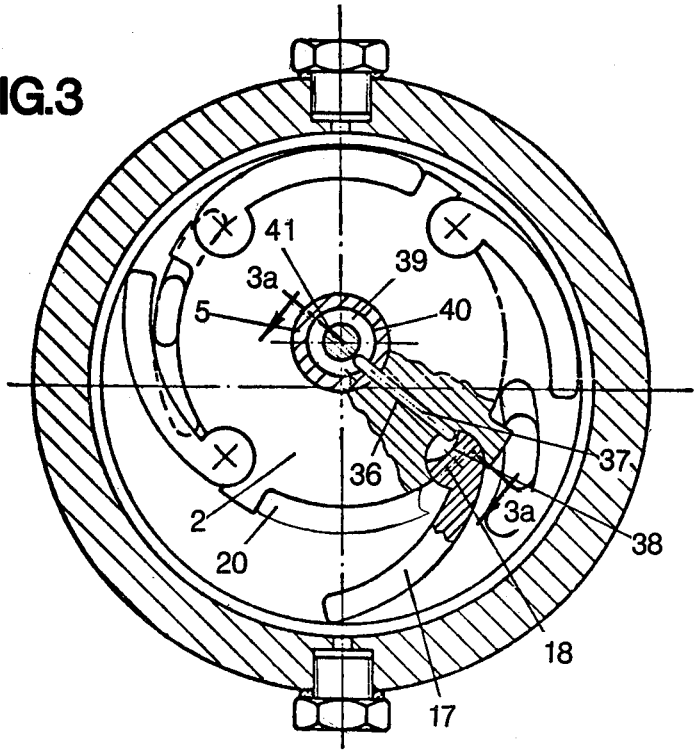
FIG. 3 is a side elevational view with an end cover removed similar to FIG. 1 showing a control mechanism for the pivoted slide vanes.

There is illustrated in FIGS. 3 and 3*a* a modified embodiment of the rotary piston in accordance with the present invention. In this instance, the assembly includes a series of radial bores 36 in the rotary piston 2 which align with radial bores in the shaft 5 located adjacent the pivot point for each of the slide vanes. A series of slide pins 37 are mounted in the radial bores with one end of the pins 37 engaging in recesses 38 in the end section 18 of the slide vane 17 and the opposite terminal end of each pin bearing against the outer peripheral conical surface 39 of an axially movable conical member 41 mounted in a central bore 40 of the shaft 5. Note that each pin engages to one side of the pivot location of the slide vanes 17 so that if the member 41 is moved inward, the pins are displaced radially outwardly to pivot the slide vanes to a position nesting in the indentations 20. In this position of the guide vanes, the rotary piston assembly does not produce any forwarding or propelling action to the medium being conveyed.

FIGS. 4 and 4*a* show a further modified rotary piston arrangement in accordance with the present invention. In this instance, each of the slide vanes is provided with at least one projection 43 on a side face 42 thereof which engages in a curved recess or bayonet-type slots 44 in the inner surface 45 of the housing confronting the side face 42. The path or trace of the recesses 44 is designed in such a way that the pivoted slide vanes are positively pressed against the inside wall 19 of the sleeve during rotation of the rotary piston. With this arrangement, the leaf springs 23 are not necessary.

FIGS. 5, 5*a* and 5*b* show a still further modified rotary piston arrangement in accordance with the present invention. In this instance, the housing includes spaced side plate members having a curved projection 51 which engages in a curved groove or recess 52 in the side face of the slide vane. In this manner sticking of the slide vanes to the contact surfaces of the rotary piston is inhibited or prevented.

By reason of the simplified shape and configuration of the slide vanes, they can be manufactured easily and economically by simply cutting them to length from preformed metal or plastic material without further machining. This is also the case with the rotary piston which can likewise be made of a preformed material so that optionally only the spiral grooves need to be machined. The rotary piston can be connected to the drive shaft in a variety of ways. For example, it can be done by means of a press fit or a key or a pin which radially penetrates the shaft and engages in a recess in the rotary piston. The slide vanes are assembled in an axial direction into the appropriate recesses in the rotary piston without the need for any additional fastening, for example, by bolts or the like. Special fastening elements which can also cause problems are therefore obviated.

The rotary piston assembly housing is also comprised of components which are easy and economical to make in a manner to produce a rather economical seal. By the present invention, the entire rotary piston assembly comprises components which are simple and inexpensive to make and are easy and quick to assemble and which as noted above is of very compact construction. The "floating" sleeve essentially eliminates or at least extensively reduces friction and wear and the spiral grooves in the interfaces are also factors contributing to useful life longevity. The present invention therefore provides a rotary piston assembly which has a long useful service life, low losses and higher efficiency.

While particular embodiments of the invention have been illustrated and described herein, it is not intended to limit the invention and changes and modifications may be made therein within the scope of the following claims. For example, instead of a cylindrical bore in the housing, the bore may be constructed from two or more cylindrical surfaces and in this case, the centrally located rotary piston can have a greater or lesser number of slide vanes than the four pivoted slide vanes illustrated. Additionally, the bearings for the shaft of the rotary piston can be rolling or plain bearings and in the latter case if plain bearings are utilized, special sliding sleeves can be omitted.

What is claimed is:

1. Rotary piston assembly comprising a housing having a bore, a piston rotatably mounted in the housing, a plurality of slide vanes pivotally supported and distributed about the circumference of said piston, means for controlling pivotal movement of said slide vanes comprising an axially movable member having a conical peripheral surface mounted in a bore of the rotary piston shaft and a plurality of elongated pins engaging in radially disposed slots in the piston disposed at an angle to a radial plane through the axis of the conical member and pivot axis of the slide vane, one terminal end of said pins engaging an arcuate recess in an end section of the slide vane and the opposite end engaging the outer peripheral surface of said conical member.

2. A rotary piston assembly as claimed in claim 1 wherein said pivoted slide vanes are disposed to extend generally tangentially to the outer surface of said piston.

3. A rotary piston assembly as claimed in claim 1 including a series of circumferentially spaced indentations in the rotary piston complementing the cross sectional shape of said slide vanes and into which the slide vanes can be folded or nested.

4. A rotary piston assembly as claimed in claim 1 including recesses or elevations between the outer peripheral surface of said rotary piston and a surface of the slide vane which confronts said peripheral surface.

5. A rotary piston assembly as claimed in claim 1 including a cylindrical sleeve rotatable in a bore of said housing.

6. A rotary piston assembly as claimed in claim 5 wherein said sleeve is provided on its outer peripheral surface with lubricant distribution means.

7. A rotary piston assembly as claimed in claim 6 wherein said lubricant distributing means comprises spiral shaped grooves.

8. A rotary piston assembly as claimed in claim 1 wherein said housing comprises two disc shaped side wall components, a center section having a bore for the rotary piston, bearings for said shaft and means for fastening the housing sections to form an integral assembly.

9. Rotary piston assembly comprising a housing having a bore, a piston rotatably mounted in the housing, a plurality of slide vanes distributed about the circumference of said piston, each side vane supported for pivotal movement about an axis parallel to the axis of rotation of said piston, said slide vanes operable to pivot and engage the bore of the housing during rotation of the piston due to the effect of centrifugal force, each of said slide vanes being of arcuate, vane shaped configuration having an enlarged end section of generally circular cross section, means defining a plurality of axially directed, circumferentially spaced arcuate recesses on the outer peripheral surface of said rotary piston to receive the end sections of said pivoted slide vanes and means for controlling pivotal movement of said slide vanes comprising an axially movable member having a conical peripheral surface mounted in a bore of the rotary piston shaft and a plurality of elongated pins engaging in radially disposed slots in the piston disposed at an angle to a radial plane through the axis of the conical member and pivot axis of the slide vane, one terminal end of said pins engaging an arcuate recess in an end section of the slide vane and the opposite end engaging the outer peripheral surface of said conical member.

* * * * *